US005887558A

United States Patent [19]

Kampichler et al.

[11] Patent Number: 5,887,558

[45] Date of Patent: Mar. 30, 1999

[54] COMBUSTION ENGINE

[75] Inventors: Guenter Kampichler, Ruhstorf; Erich Eder, Vornbach, both of Germany

[73] Assignee: Motorenfabrik Hatz GmbH & Co. KG, Ruhstorf, Germany

[21] Appl. No.: 843,172

[22] Filed: Apr. 14, 1997

Related U.S. Application Data

[62] Division of PCT/EP95/04002, Oct. 11, 1995.

[30] Foreign Application Priority Data

Oct. 15, 1994 [DE] Germany ..... 44 36 969.7

[51] Int. Cl.[6] ..... F02F 1/16

[52] U.S. Cl. ..... 123/193.2

[58] Field of Search ..... 123/193.2, 193.1, 123/193.3

[56] References Cited

U.S. PATENT DOCUMENTS

| | | | |
|---|---|---|---|
| 2,279,671 | 4/1942 | Ford . | |
| 2,674,782 | 4/1954 | Surtees . | |
| 3,792,518 | 2/1974 | Cross et al. . | |
| 4,630,345 | 12/1986 | Lutz . | |
| 4,637,110 | 1/1987 | Yamagata | 123/193.2 |
| 5,477,820 | 12/1995 | Rao | 123/193.2 |
| 5,570,668 | 11/1996 | Hsu | 123/193.2 |
| 5,582,144 | 12/1996 | Misutani | 123/193.2 |

*Primary Examiner*—Marguerite McMahon
*Attorney, Agent, or Firm*—Helfgott & Karas, P C.

[57] ABSTRACT

A particularly reasonably priced cylinder liner (1) for combustion engines, especially for one-cylinder diesel engines with a cylinder (2) cast on the crankcase, is produced from steel by deep drawing or deformation by compression and inserted with a tight sliding fit into the cylinder bore (12).

23 Claims, 2 Drawing Sheets

COMBUSTION ENGINE

This application is a division of PCT/EP95/04002 filed Oct. 11, 1995.

BACKGROUND OF THE INVENTION

The invention relates to a combustion engine with one or more cylinders, which are lined with liners, which are produced from steel by deep drawing or by deformation by compression.

From methods for repairing, in particular, large engines and those, for which the crankcase is cast in one piece with the cylinders, the idea was developed, for reasons of costs, of using cylinder liners. The worn or damaged cylinders are drilled out, provided that the wall thickness permits such a procedure, and the cast cylinder liner, the bore of which corresponds to the original, is then inserted, so that the pistons can continue to be used.

There are also engine constructions, for which cylinder liners are inserted from the very start as an exchangeable part (DE 4029427 A1). In general, these cylinder linings are produced by the centrifugal casting method and have a wall thickness of 2.5 to 3.5 mm. The liner is pushed in without external finishing and honed on its running surface to fit to the piston diameter.

Such measures do not come into consideration for inexpensive engines, such as small one-cylinder engines, since the costs associated therewith are too high in relation to the total costs of a new cylinder block or a new engine.

However, from the point of view of preserving raw materials, it is desirable to line small engines, instead of having to discard them after they are worn out.

Accordingly, it is an object of the present invention to make the repair even of inexpensive engines meaningful from an economic point of view.

A known, particularly thin-wall liner (U.S. Pat. No. 2,229,671) requires that the manufacturing process be highly accurate, since the liners are inserted dry into the cylinder bore. In this connection, it is important to realize a gap-free press fit in order to achieve undisturbed conduction of heat. This fit is achieved using a certain flexibility of the liner wall, which has a very small thickness. After the known liner is inserted into the cylinder bore, its running surface is lapped.

SUMMARY OF THE INVENTION

On the other hand, according to the inventive proposal, the cylinder liner is inserted with a close sliding fit into the assigned cylinder bore and, moreover, with a tolerance which, under operating temperature conditions, ensures an annular gap between the liner and the cylinder wall with a width of 20 to 40$\mu$, the annular gap being connected to circulating lubricating oil.

The dissipation of heat between the cylinder liner and the blind-end bore of the crankcase, which forms the inside of cylinder wall, is ensured by a film of oil, which is maintained by the circulating oil. The oil passes through a borehole to the inside of the cylinder wall and is distributed there by means of a preferably spirally shaped lubricating groove over the whole height of the liner.

The lubricating oil is supplied in the vicinity of the cylinder-head end, passes through the annular gap between the cylinder liner and the cylinder wall and finally emerges through an appropriate peripheral gap between the cylinder wall and the lower end of the cylinder liner, from where it reaches the oil sump of the crankcase housing.

Advisably, at its cylinder-head end, the liner has a 3 to 4 mm wide peripheral collar, which protrudes downward to the outside and engages a corresponding annular groove of the end face of the cylinder. The tolerances of the annular groove and the collar of the cylinder liner are such, that the liner is pressed firmly and sealed over the cylinder head seal by the cylinder head. For this purpose, it is advisable that the collar protrudes axially slightly over the end face of the cylinder wall for the purpose of creating a tight connection with the cylinder head seal.

The thickness of the collar can be selected so that the collar replaces the cylinder head seal.

The inventive cylinder liner, produced from steel without metal-cutting processes as a seamless, shaped part, preferably by deep drawing or by pressure shaping, has a wall thickness of 0.5 to 1 mm; the running surface of the liner can be improved by nitriding, hard-chromium plating or treatment with a special honing method for the purpose of producing smaller oil pockets. In other respects, the exchange of a worn liner for a new one is accomplished without any machining of the cylinder block.

Suitable manufacturing methods make an adequate accuracy of about ± 30$\mu$ possible; smaller deviations in shape are compensated for owing to the fact that the cylinder liner is inserted with little play in the blind-end borehole of the crankcase, a slightly sliding fit with a diameter tolerance of 40 to 80$\mu$ having proven to be advantageous.

On the one hand, the oil, flushing the outer periphery of the cylinder liner, cools directly; in particular, however, it improves the heat transfer to the cooled cylinder wall. By such a procedure, it is also not possible for harmful air inclusions and air bridges to be formed in the annular gap. Moreover, the flushing with oil helps to center and support the cylinder liner within the cylinder wall, the lubricating oil filling the annular gap, which enlarges from that of the cold state when the engine is operating due to the different thermal expansion of the steel cylinder liner and of the diecast cylinder wall. This becomes particularly clear in the case of a diecast aluminum cylinder block, the thermal expansion of which is significantly larger than that of steel.

Advisably, provisions are furthermore made in the end face of the cylinder wall for forming pockets, undergrasping the collar and intended for accommodating a tool for disassembling the cylinder liner.

BRIEF DESCRIPTION OF THE DRAWINGS

An example of the invention is described in greater detail in the following by means of the drawing in which.

DESCRIPTION OF A PREFERRED EMBODIMENT

Figure 1:
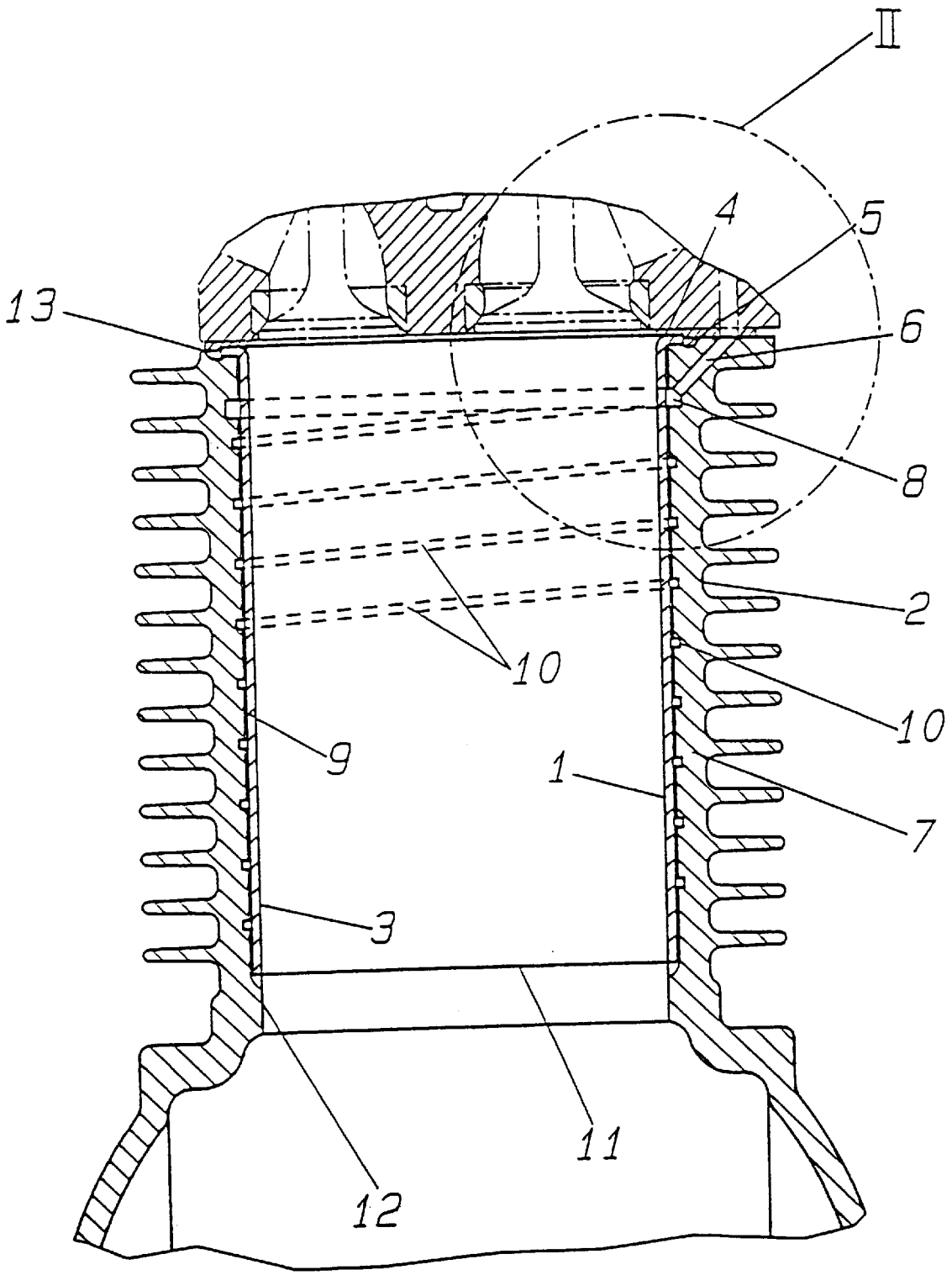
FIG. 1 shows the upper part of the engine block with an axial section through the cylinder liner and FIG. 2 shows a detail II of FIG. 1.

FIG. 1 shows an axial section through the cylinder liner 1, which is used in the interior of a cylinder 2, which is made, for example, from diecast aluminum and cast in one piece with the crankcase of a one-cylinder diesel engine, which is not shown. Compared to the known exchangeable, centrifugally cast liners, the cylinder liner 1 is an inexpensive part, which is produced by deep drawing from a steel billet and obtainable commercially at a small fraction of the price of a conventional, centrifugally cast liner. With its cylinder part 3, which has a wall thickness of 0.5 to 1 mm and forms the running surface, the cylinder liner 1 is mounted with a slightly sliding fit in the interior of the cylinder wall 7, that is, an annular gap 9 of 20 to 40$\mu$ is allowed. At its cylinder-head end, the liner 1 has a peripheral collar 4, which is accommodated in a corresponding annular groove in the end face 13 of the cylinder wall 7. In the end face 13 of the cylinder wall 7, several pockets 5, are formed for gripping under the collar 4, which are provided for the entry of a tool for dismantling the cylinder liner 1.

Between the cylinder liner 1 and the inner wall of the cylinder 2, an oil film 15 is provided for the purpose of improving heat transfer and in the interest of a uniform mechanical support. The oil film is supplied by a feed line 6 through the cylinder wall 7 with an oil pressure of 1 to 2 bar. A peripheral groove 8 at the inner end of the feed line 6 ensures a uniform distribution of the oil supplied over the whole periphery of the annular gap 9. A spiral-shaped lubricating groove 10 in the inner wall of the cylinder 2 distributes the lubricating film uniformly. The cross section of the groove corresponds approximately to a depth of 1 mm and a width of 2 mm. The lubricating groove may be formed either during the diecasting method or machined subsequently. If anything, the gradient of the spirally-shaped lubricating groove 10 is slight, for example, 1:10.

With its outer edge 11, the cylinder liner 1 ends outside of the contour of the cylinder bore 12 adjoining below, so that it is possible to install the piston from below. The lubricating oil, which emerges from the lower end of the annular gap 9, runs free of pressure along the cylinder wall 7 downwards into the oil sump of the crankcase.

Figure 2:
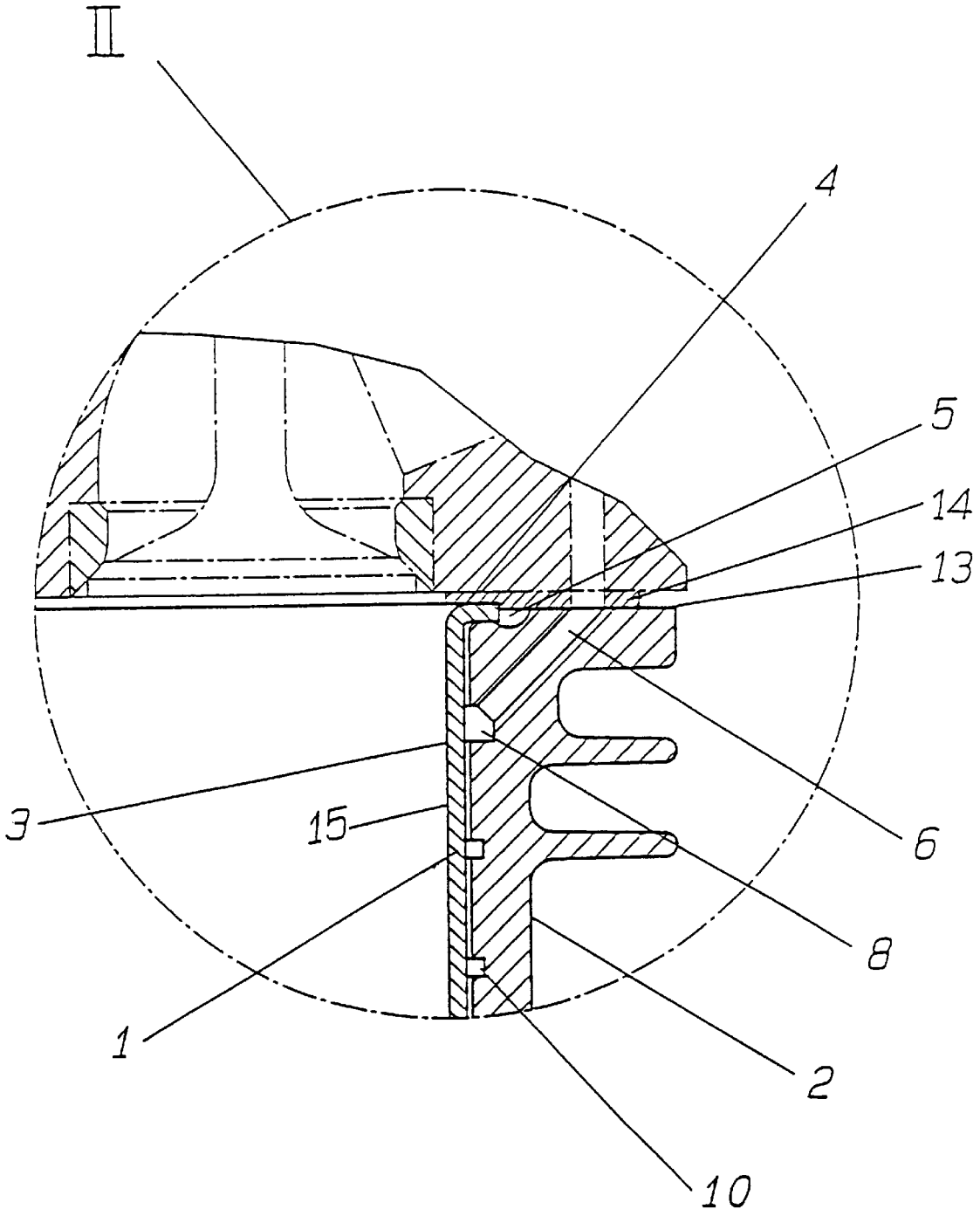

The collar 4 of the cylinder liner 1 protrudes slightly over the cylinder-head end face 13 of the cylinder wall 7, so that reliable sealing is achieved by the cylinder head seal 14 shown in FIG. 2.

As a result of its thin wall thickness, the cylinder liner 1 easily adapts to any tolerance deviations in the circular symmetry; furthermore, it makes slight transverse motions possible, in adaptation to the lifting direction of the piston, which are damped by the oil film. Due this slight mobility, the service life of the cylinder liner is improved, so that its value lies above 1,000 operating hours. The old cylinder liner is levered out with tools (not shown), which fit into the pockets 5 below the edge of the collar 4; the new liner is inserted without any subsequent machining work. The exchange of the cylinder liner 1 thus is economically meaningful also for one-cylinder small diesel engines.

We claim:

1. A combustion engine with one or several cylinders (2), which are lined with cylinder liners (1) characterized in that the cylinder liner (1) is inserted with tight sliding fit into the assigned cylinder bore (12) with a tolerance, which ensures an annular gap (9) between the liner (1) and the cylinder wall (7) with a gap width of 20 to 40$\mu$ at the operating temperatures, and in that the annular gap (9) is connected to cycling lubricating oil.

2. The combustion engine of claim 1, wherein an inside of the cylinder wall (7) is provided with lubricating grooves (10) so that a closed oil film is maintained in the annular gap (9).

3. The combustion engine of claim 1, the cylinder liner (1) at the cylinder-head side having a collar (4), which is accommodated in an annular groove in an end face (13) of the cylinder wall (7), wherein the collar (4) protrudes axially slightly over the end face (13) for creating a tight connection with the cylinder head seal (14).

4. The combustion engine of claim 3, characterized in that the collar (4) is thin and replaces the cylinder head seal (14).

5. The combustion engine of claim 3, wherein the end face (13) of the cylinder wall (7) includes several pockets (5) for gripping under the collar (4) by entry of a tool between said collar and said end face for dismantling the cylinder liner (1).

6. The combustion engine of claim 1, wherein the cylinder liner (1) has a running surface with a roughness for forming oil pockets.

7. The combustion engine of claim 6, wherein a running surface of said liner is subjected to a surface treatment by at least one of nitriding chrome plating, chromium plating and honing.

8. The combustion engine of claim 1, wherein the wall thickness of a cylinder part (3) of the cylinder liner (1) is 0.5 to 1 mm.

9. A combustion engine as in claim 1, further comprising said pressurized lubricating oil filling said gap and said grooves to cool said liner and to cushion said liner in said bore.

10. A combustion engine as in claim 9, wherein said oil pressure at said inlet is in a range of approximately 1 bar to 2 bar.

11. A combustion engine as in claim 1, further comprising a source of said pressurized lubricating oil.

12. A combustion engine as in claim 1, wherein said liner is steel and is produced by one of deep drawing and deformation by compression.

13. A combustion engine, comprising:

at least one-cylinder bore having an inner-wall;

at least one cylinder liner, a cylinder liner being positioned respectively in each said at least one cylinder bore, said liner having an inner running surface, said inner wall of said cylinder bore and said liner having a tight sliding fit between them, an annular gap with a width of 20$\mu$ to 40$\mu$ existing between said bore and said liner at engine operating temperatures;

communication means providing an inlet to said annular gap for connection to a pressurized source of circulating lubricating oil, thereby said gap fills with said pressurized oil and is a flow path therefor.

14. The combustion engine of claim 13, wherein said inner wall includes lubricating grooves to maintain a closed oil film in the annular gap.

15. The combustion engine of claim 13, wherein the cylinder liner has a collar at a cylinder-head side of said engine, said collar fitting in an annular groove in an end face of the cylinder inner wall, said collar protruding axially slightly beyond the end face to create a tight connection with a cylinder head seal.

16. The combustion engine of claim 13, wherein a cylindrical wall thickness of the cylinder liner is 0.5 mm to 1 mm.

17. The combustion engine of claim 15, wherein the end face of the cylinder wall includes pockets for gripping under the collar by entry of a tool between said collar and said end face for dismantling the cylinder liner.

18. The combustion engine of claim 13, wherein said running surface has a roughness for forming oil pockets.

19. The combustion engine of claim 18, wherein the running surface has a surface treatment.

20. The combustion engine of claim 19, wherein said surface treatment is by at least one of nitriding chrome plating, chromium plating, and honing.

21. A combustion engine as in claim 13, further comprising said pressurized lubricating oil filling said gap and said grooves to cool said liner and to cushion said liner in said bore.

22. A combustion engine as in claim 21, wherein said oil pressure at said inlet is in a range of approximately 1 bar to 2 bar.

23. A combustion engine as in claim 13, further comprising a source of said pressurized lubricating oil.

* * * * *

UNITED STATES PATENT AND TRADEMARK OFFICE

CERTIFICATE OF CORRECTION

PATENT NO. : 5,887,558
DATED : MARCH 30, 1999
INVENTOR(S) : Guenter KAMPICHLER, et al.

It is certified that error appears in the above-indentified patent and that said Letters Patent is hereby corrected as shown below:

On the title page, Related U.S. Application Data, Item[62], delete "Division" and insert --Continuation--.

Signed and Sealed this

Twenty-first Day of September, 1999

*Attest:*

Q. TODD DICKINSON

*Attesting Officer*

*Acting Commissioner of Patents and Trademarks*